US008590637B2

(12) United States Patent
Brunet et al.

(10) Patent No.: US 8,590,637 B2
(45) Date of Patent: Nov. 26, 2013

(54) APPARATUS AND METHOD FOR CONTROLLING THE FEED-IN SPEED OF A HIGH PRESSURE HOSE IN JET DRILLING OPERATIONS

(76) Inventors: Charles Brunet, Houston, TX (US); Michel Bouchard, Calgary (CA); Kevin Mazarac, Houma, LA (US)

( * ) Notice: Subject to any disclaimer, the term of this patent is extended or adjusted under 35 U.S.C. 154(b) by 266 days.

(21) Appl. No.: 13/057,392

(22) PCT Filed: Aug. 3, 2009

(86) PCT No.: PCT/US2009/052588

§ 371 (c)(1),
(2), (4) Date: Mar. 14, 2011

(87) PCT Pub. No.: WO2010/017139

PCT Pub. Date: Feb. 11, 2010

(65) Prior Publication Data

US 2011/0147088 A1 Jun. 23, 2011

Related U.S. Application Data

(60) Provisional application No. 61/137,786, filed on Aug. 4, 2008.

(51) Int. Cl.
*E21B 7/18* (2006.01)

(52) U.S. Cl.
USPC ..... 175/62; 175/424

(58) Field of Classification Search
USPC ..... 175/61, 62, 73, 79, 424
See application file for complete search history.

(56) References Cited

U.S. PATENT DOCUMENTS

| | | | | |
|---|---|---|---|---|
| 6,189,629 | B1 | 2/2001 | McLeod et al. | |
| 6,315,054 | B1 | 11/2001 | Brunet | |
| 6,374,918 | B2 | 4/2002 | Roberts et al. | |
| 8,167,060 | B2 * | 5/2012 | Brunet et al. | 175/424 |
| 2006/0169495 | A1 | 8/2006 | Kolle | |

* cited by examiner

*Primary Examiner* — William P Neuder
(74) *Attorney, Agent, or Firm* — McGarry Bair PC

(57) ABSTRACT

A jetting hose is conveyed downhole retracted on the end of a tubing string (coiled tubing) for jetting lateral boreholes from a main wellbore. The apparatus allows the operator to sense the speed at which the jetting hose and nozzle are penetrating the formation and adjust the coiled tubing feed-in rate accordingly, optimizing both the direction and length of the lateral borehole relative to the main wellbore.

20 Claims, 7 Drawing Sheets

APPARATUS AND METHOD FOR CONTROLLING THE FEED-IN SPEED OF A HIGH PRESSURE HOSE IN JET DRILLING OPERATIONS

CROSS-REFERENCE TO RELATED APPLICATIONS

This application is a National Phase application of International Application No. PCT/US2009/052588, filed Aug. 3, 2009, which claims the benefit of U.S. Provisional Application No. 61/137,786, filed Aug. 4, 2008, both of which are incorporated herein by reference in their entirety.

BACKGROUND OF THE INVENTION

1. Field of the Invention

The invention relates to an apparatus and methods for drilling lateral boreholes from a main wellbore using a high pressure jetting hose for hydrocarbon recovery. In one of its aspects, the invention relates to an apparatus and method for controlling the speed at which a high pressure jetting hose is advanced into a producing formation on the end of a tubing string.

2. Description of Related Art

The creation of lateral (also known as "radial") boreholes in oil and gas wells using high pressure radial jetting was first introduced in the 1980's. Various tools have been used to create a lateral borehole for the purpose of extending the "reach" of the wellbore. The most currently accepted approach involves milling holes in the wellbore casing, and then subsequently using a tubing string (usually coiled or jointed tubing) to lower a high pressure jetting hose with a nozzle on its leading end into the reservoir. The configuration of the nozzle is such that it contains more opening area in the rearward facing direction than the forward direction, resulting in a forward thrust on the nozzle that pulls the hose behind it as the lateral borehole is created.

The upper end of the more-flexible jetting hose is affixed to the lower end of the less-flexible tubing string, and it is therefore desirable to feed the tubing string into the wellbore at the same speed at which the jetting nozzle is creating a lateral borehole. If the tubing feed rate is too fast, the jetting nozzle path becomes erratic and the borehole is not straight; too slow, and the jetting nozzle creates a cavity behind itself resulting in the loss of forward thrust and a borehole that is shorter. The optimal penetration rate of the jetting nozzle, and thus the optimal rate at which the tubing is fed into the wellbore, is thus dictated by the nozzle's forward and backward jets and the thrust they create.

Historically, the tubing string used to convey the jetting hose is small diameter coiled tubing of ½" (inch) or less. The jetting hose is typically ¼" (inch) high-pressure hydraulic hose attached to the end of the small diameter coiled tubing. This small diameter tubing possesses sufficient sensitivity and flexibility for the operator to maintain good control over the feed-in rate from the surface. The operator uses surface gauges to compare the hanging weight of the relatively lightweight (for example, 4 ft/lb) small diameter tubing to the pressure drop at the jetting nozzle, and typical sensitivity of 25-lbs is generally available.

The prior approach using small diameter flexible coiled tubing is limited, however, in terms of depth, downhole inclination angles, utilization in flowing wells, and other problem areas. Small diameter tubing also requires its own additional tube-feeding units on the surface, in addition to the standard diameter coiled tube-feeding units usually present for other phases of the drilling operation.

Using standard size coiled tubing to advance the jetting hose during lateral borehole formation would reduce or eliminate many of the depth, strength, angle, and feed unit problems noted above. But standard coiled tubing greatly reduces sensitivity and control over the jetting hose. Because success in drilling lateral boreholes using a jetting hose is greatly dependent on the sensitivity of the measurements at the surface of the well, any reduction in the operator's ability to gauge the rate of advance of the jetting hose on the end of the tubing reduces the operator's ability to control the penetration rate at which the jetting hose advances into the formation.

Standard size coiled tubing is generally constructed from carbon or stainless steel and deformably wrapped on a powerful reel on the surface; is typically on the order of 1¼" to 1½" (inches) in diameter or larger; and weighs significantly more (for example, 2 lbs/ft) than the small diameter coiled tubing used in the prior art. Using standard sized coiled tubing makes it significantly more difficult to control the tubing feed rate relative to the jetting nozzle penetration rate using standard weight-versus-pressure comparisons. For example, the weight gauges for standard coiled tubing are typically in 100-lb to 200-lb increments, and are simply not sensitive enough to use the hanging weight of the tubing as a benchmark for comparison to the feed-in rate and jetting nozzle pressure drop, even by a skilled operator.

Thus the use of standard coiled tubing and other larger-diameter, stronger, deep-application hose-conveying equivalents for the tubing string (such as jointed pipe with threaded connections on either end) has been discouraged.

SUMMARY OF THE INVENTION

According to the invention an apparatus for jetting lateral boreholes in a formation from a main wellbore using a high pressure jetting hose conveyed down the wellbore by tubing, the jetting hose supplied with pressurized jetting fluid through the tubing. A speed control sub is connected between at least a portion of the tubing and the jetting hose. The speed control sub comprises a jetting fluid path for passing the pressurized jetting fluid from the tubing portion to the jetting hose. The speed control sub is configured to maintain the pressure of the jetting fluid flowing to the speed control sub at a predetermined level when a force between the speed control sub and the jetting hose is at a first predetermined level and to change the pressure of the jetting fluid flowing to the speed control sub from the predetermined level when the force between the speed control sub and the jetting hose increases from the first predetermined level. The speed control sub is responsive to a higher feed-in rate of the tubing down the wellbore relative to a thrust-determined jetting rate of the hose through the formation to cause a noticeable pressure change in the pressurized jetting fluid to an operator.

In one embodiment, the speed control sub has a first part that is connected to the jetting hose and a second part that is connected to the portion of the tubing, and wherein the first and second portion are axially movable with respect to each other. The first and second portions can be biased with respect to each other toward a first relative position. The first and second parts of the speed control sub can be in the first relative position when the force between the speed control sub and the jetting hose is at the first predetermined level. The first and second parts of the speed control sub can further be in a second relative position when the force between the speed control sub and the jetting hose increases to a second predetermined level.

In another embodiment, a damper is provided to dampen the movement of the first and second parts of the speed control sub between the first and second positions. The damper can comprise first and second chambers connected by a restricted passageway. The restricted passageway can include a metering valve.

In another embodiment, the speed control sub can further comprise a vent in the jetting fluid path to vent pressurized jetting fluid from the jetting fluid path when the force between the speed control sub and the jetting hose is increased from the first predetermined level. The vent can be adapted to vent the jetting fluid only when the force between the speed control sub and the jetting hose increases to a second predetermined level.

In another embodiment, the speed control sub can be configured to change the pressure of the jetting fluid flowing to the speed control sub from the predetermined level only when the force between the speed control sub and the jetting hose increases to a second predetermined level.

In yet another embodiment, the speed control sub can be configured to decrease the pressure of the jetting fluid flowing to the speed control sub from the predetermined level when the force between the speed control sub and the jetting hose increases. The apparatus the speed control sub can configured to decrease the pressure of the jetting fluid flowing to the speed control sub from the predetermined level only when the force between the speed control sub and the jetting hose increases to a second predetermined level.

Further according to the invention, a method for jetting lateral boreholes from a main wellbore using a high pressure flexible jetting hose comprising lowering the high pressure flexible jetting hose down a wellbore with a tubing string while supplying the jetting hose with pressurized jetting fluid through the tubing string from the surface and providing a noticeable pressure signal to an operator on the surface if a feed-in rate of the tubing string down the wellbore exceeds a predetermined rate of advance of the jetting hose through a formation adjacent the wellbore.

In one embodiment, the notice pressure signal is a drop in the pressurized jetting fluid.

The speed control sub is primarily intended for use with a jetting hose fixedly connected to the end of the tubing. It can also be used with an extendable jetting hose arrangement such as that shown in co-pending U.S. patent application Ser. No. 12/203,504 filed Sep. 3, 2008, provided the jetting hose (with attached speed control sub) is extended fully from a retracted position in the tubing and held in place relative to the tubing before being lowered by the tubing to jet a lateral borehole. In both cases the speed control sub functions to help the operator gauge and control the tubing feed-in rate relative to the jetting rate of the hose, where the hose is operatively fixed to the tubing and lowered by the tubing to jet a lateral.

The speed control sub can be connected to the lower end of the tubing and to the upper end of the jetting hose. The speed control sub can include a piston or sleeve movable in a housing and biased toward the lower end of the housing. The piston can be connected to the upper end of the jetting hose to slidably space the upper end of the jetting hose from the lower end of the tubing. If the tubing is lowered faster than the rate at which the jetting hose is creating a borehole under the driving pressure of the jetting fluid supplied from the surface, the bias force is overcome and the piston moves to selectively open a fluid passage in the speed control sub to create a sudden, noticeable drop in fluid pressure. This sub-induced pressure drop gives the operator an indication of the tubing feed-in rate relative to the rate at which the jetting hose nozzle is forming the borehole.

The invention accordingly provides a detectable pressure drop or increase by which the operator can easily determine the correct speed at which to lower the tubing during the creation of a lateral borehole by jetting, while keeping the jetting hose in tension, i.e. wherein the hose penetrates the formation at a rate approximately equal to the rate at which the hose is lowered into the wellbore by the tubing. Operator skill will still have an effect on how close to "equal" the tubing feed-in rate will be to the rate of advance of the jetting hose, but the ability of the operator to gauge accurately is significantly improved.

The speed control sub also provides a means for controlling how quickly the sub shifts to induce the pressure drop when force is applied to the tubing that exceeds the thrust force being generated by the jetting hose, and to set how much force is required for the pressure drop shift. In the preferred form of the invention, the shift control is a spring. In an alternate form of the invention, the shift control can be a hydraulic medium.

These and other features and advantages of the invention will become apparent from the detailed description below, in light of the accompanying drawings.

DESCRIPTION OF THE PREFERRED EMBODIMENT

Figure 1:
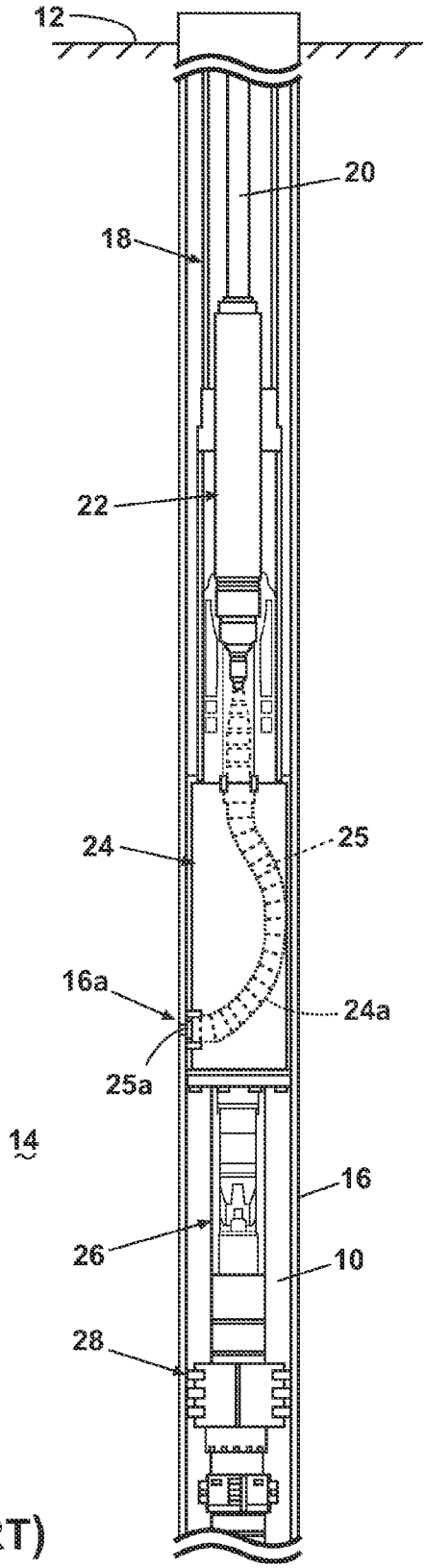
Fig. 1 (PRIOR ART)
FIG. 1 is a side view of a prior art casing milling assembly on the end of a mud motor as it is landed in a deflector shoe to initiate milling operations.

FIG. 1 shows a prior assembly used for cutting lateral openings in the casing 16 of a vertical or "main" wellbore 10, and for subsequently redirecting a jetting hose out through the openings to jet lateral boreholes in formation 14. This is a typical (but not exclusive) example of a wellbore and the structural environment and orientation in which the present invention can be used. In general, the assembly includes a deflector shoe 24 supported at or near the bottom of the workstring, for example secured to the end of the production tubing 18, and a flexible linked cutting tool 25 rotatably driven by a mud motor 22 lowered on the end of standard tubing string 20 (e.g., coiled tubing). Cutting tool 25 is selectively extended through a conduit 24*a* in deflector 24 to place cutting head 25*a* in contact with the wellbore casing 16, forming one or more lateral openings 16*a* for entry of a jetting hose into the surrounding formation 14 in known manner. The rotational positioning of deflector shoe 24, and thus of the cutting tool 25 and the location of the lateral hole(s) 16*a* that it forms, is determined by an indexer device 26. The assembly is vertically locked in place by anchor 28 while the holes are formed.

Further details of the assembly shown in FIG. 1 are described in more detail in US 2008/0115940, and US 2007/0125577, both of which are incorporated herein by reference in their entirety. It will be understood by those skilled in the art, however, that other methods and devices for deflecting a cutting tool to form a lateral opening in the wellbore casing, and for subsequently deflecting or redirecting a flexible jetting hose through the lateral opening to jet a lateral borehole, are known and are capable of being used with the present invention that will now be described.

Figure 2:
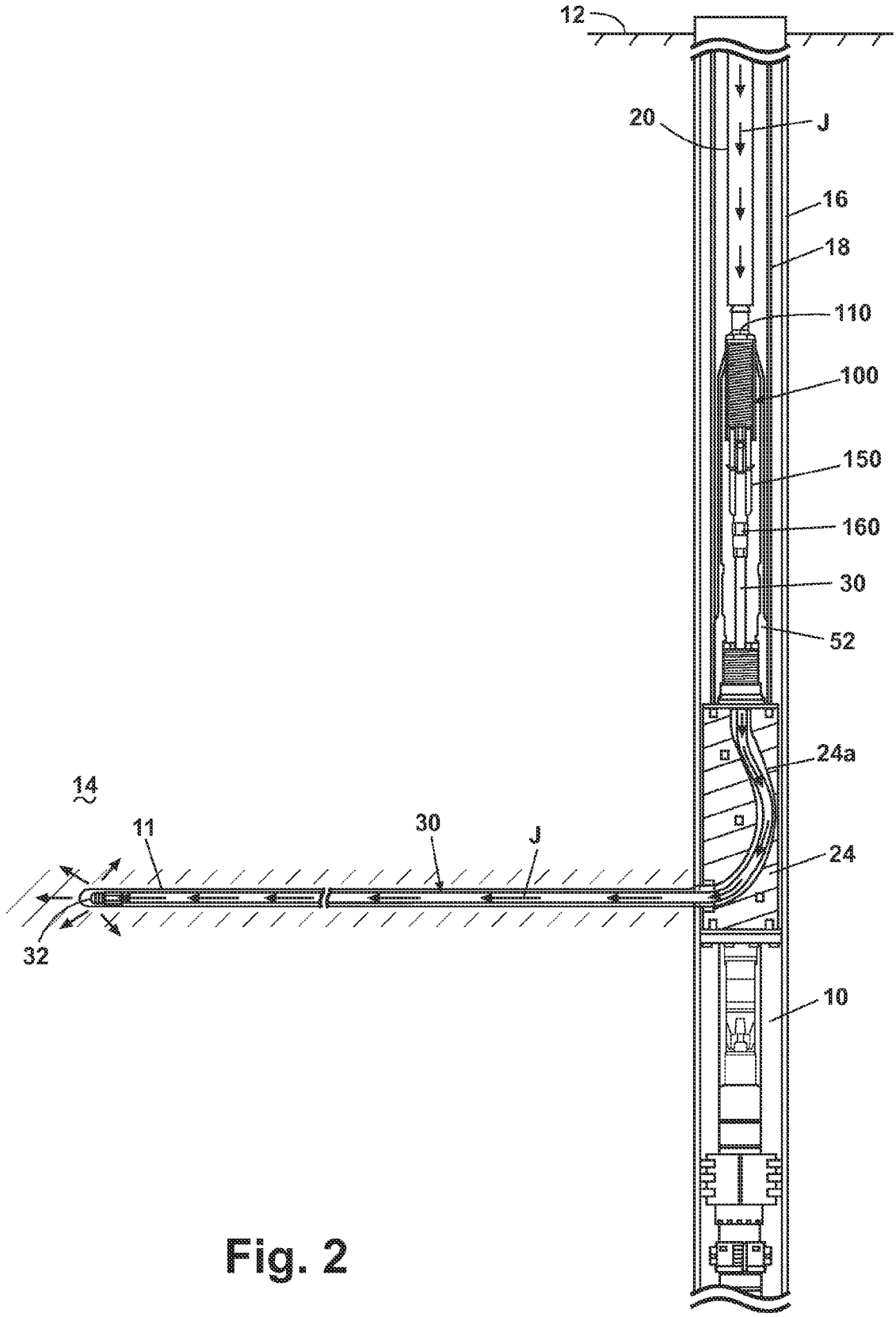
FIG. 2 shows the wellbore of FIG. 1, with the milling assembly removed and replaced by a jetting hose lowered by coiled tubing and redirected out of the wellbore to jet a lateral borehole, the jetting hose being connected to the end of the coiled tubing by a speed control sub according to the invention.

Referring next to FIG. 2, the milling assembly has been withdrawn from wellbore 10, and standard coiled tubing 20 is being used in known fashion to lower a jetting hose 30 into the deflector 24. Deflector 24 redirects hose 30 laterally (or radially, generally at a 90° direction with respect to the axis of the wellbore 10) out from the wellbore to jet a lateral borehole 11 in formation 14, using pressurized jetting fluid (illustrated by arrows J) exiting front and rear from jetting head 32. The fluid exiting from the front of nozzle 32 cuts through the formation, while the fluid exiting rearwardly from nozzle 32 creates a thrust force tending to drive the jetting head 32, and pull the hose 30, further into the formation.

Because hose 30 is flexible, and can be hundreds of feet long, advancing coiled tubing 20 too slowly can result in erosion of a cavity in the borehole or "lateral" 11, resulting in a shorter than optimal lateral. Advancing coiled tubing 20 too quickly results in an erratic lateral, rather than the optimal straight direction (usually but not exclusively perpendicular) from the main wellbore 10. There is an optimal distance between the front jets and the formation. Pushing the jetting head directly against the formation reduces the cutting efficiency of the jetting head 32.

Figure 9:
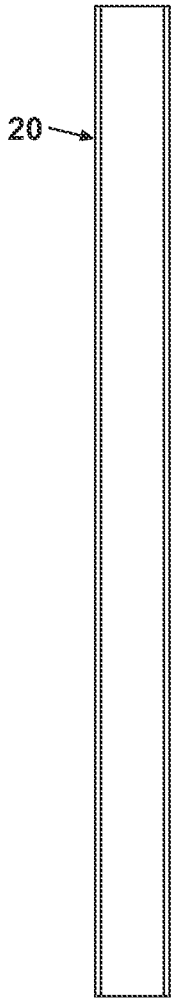
FIGS. 9 and 10 show side elevation views, in cutaway, of coiled tubing and jointed tubing, respectively.

In its basic form (see FIG. 9), standard tubing string 20 is a string of "endless pipe" or "coiled tubing" which is commercially available in standard sizes from ½" to 2⅞" (inches) in diameter or more. The currently preferred size of tubing used with the present invention is in the range from 1" to 1½" in diameter. The tubing has a high burst rating, generally in excess of 10,000 psi. The tubing is raised and lowered in the wellbore 10 using a standard tube-feeding unit, including a reel at the surface of the earth to wrap the tubing for dispensing into and withdrawal from the well bore. The coiled tubing is straightened as it goes through an injector head and forced into the wellbore. The tubing is typically made from various grades of steel; however, other materials such as titanium or composites can be used to construct the tubing.

Figure 10:
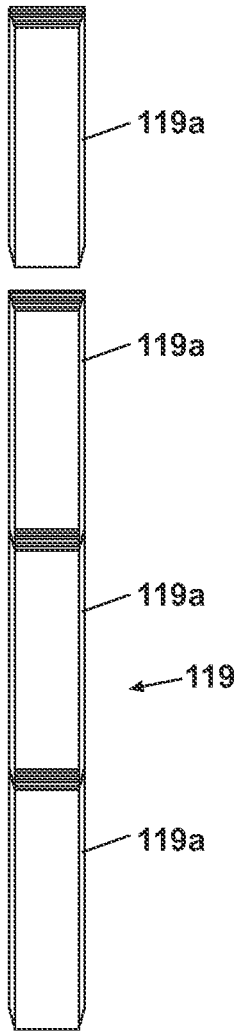

Alternatively, jointed tubing string 119 (FIG. 10) of known type can be substituted for standard coiled tubing 20. The jointed tubing joints or sections 119*a* can be in the range from 1" to 2½" in diameter with threaded connections on each end. The sections 119*a* are assembled on the surface in known manner as the tubing 119 is lowered into the wellbore. The jointed pipe is generally made of steel or other ferrous metal. Generally, pipe capable of operating at high pressures of 5000 psi or more is used. The jointed pipe can be coated or uncoated. The pipe can contain threads on each end for attachment to the tubing string and deflector shoe, or a flange or other type of connection can be used. Although tubing joints 119*a* are usually connected with the illustrated threaded connections, alternative quick-connect fittings can be fastened to the ends of the pipe joints to reduce the time required to fasten the pipe joints together.

Although coiled tubing and jointed tubing are the preferred examples, the invention can be used with other types of tubing suitable for conveying jetting hose 30 for the jetting operation.

The depth of the wellbore 10 and the length of tubing 20 can run into the thousands of feet, and the length of jetting hose 30 can be hundreds of feet. For purposes of illustration, wellbore, tubing and hose are shown foreshortened in the drawings.

Flexible jetting hose 30, generally in a size of ½" to ¾" in diameter, is mounted on the leading end of the tubing string 20 through a speed control sub 100. Jetting hose can be reeled onto and off of a reel many times during its useful life. The jetting hose also has sufficient structural strength to support it within the well bore so that it can be lowered into and pulled from a wellbore as required. The jetting hose is capable of operating at a high fluid pressure, often 3,000 psi or more. Jetting hose 30 can be manufactured in different sizes larger than the standard small diameter size of ½" to ¾" generally used in the illustrated embodiment. Illustrated jetting hose 30 is flexible enough to be bent to turn through a 90-degree curve in a 2½" diameter, and has a pressure rating from 3,000 psi up to 10,000 psi. Jetting hose 30 is typically constructed of steel or Kevlar reinforced elastomer.

Figure 3:
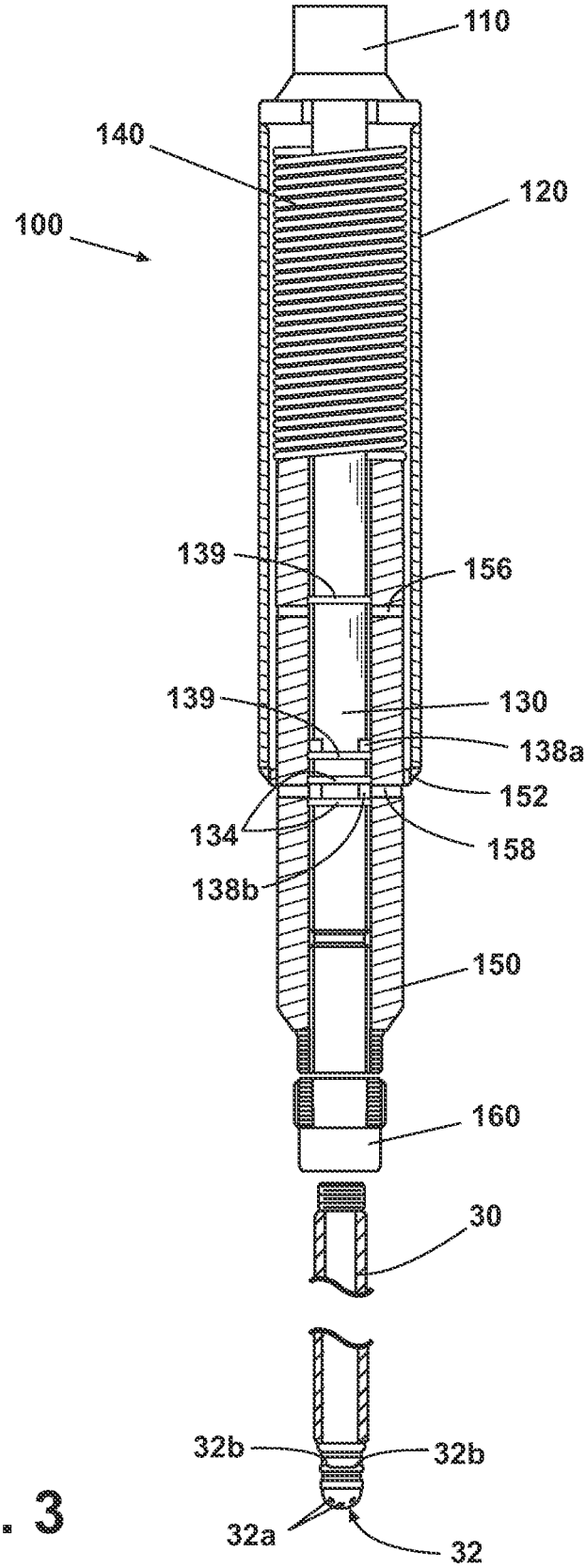
FIG. 3 is a detailed side elevation view of the speed control sub of FIG. 2.

As best shown in FIG. 3, jetting head or nozzle 32 is of a type generally known in the art, containing one or more openings 32*a* oriented in a forward direction for drilling purposes, as well as one or more openings 32*b* oriented in a reverse or rearward direction for mostly thrust purposes. The rear jets are also useful in enlarging the laterals and removing the cuttings. High pressure jetting fluid J pumped down the tubing string 20 from the surface accordingly enters the jetting nozzle 32 through hose 30, with a portion of the fluid exiting the forward end of the jetting nozzle via holes of known type and pattern, and the remaining fluid exiting the jetting nozzle on the opposite, rear end via holes of known type and pattern. As illustrated in FIG. 2, the fluid exiting the forward end impacts the formation 14, cutting a lateral borehole, i.e. drilling in the forward direction. The fluid exiting the jetting nozzle on the rear end has the effect of forcing the nozzle in the forward direction. The openings in the jetting nozzle 32 are sized to cause a certain pressure drop based on the amount of fluid per unit time exiting the nozzle, and subsequent propulsion force is generated as a result.

As the jetting nozzle 32 is propelled forward, it places a tension force on the jetting hose 30 and on the tubing string 20 when the hose 30 is fully extended from the tubing string. This force counterbalances the force from the reaction of the fluid exiting the forward-facing openings against the formation, pushing the jetting hose 30 forward at a pace equal to the rate at which the formation is eroded in advance of the jetting nozzle 32 as illustrated in FIG. 2. In addition, there is a friction drag on the jetting hose from the formation and from the deflector shoe 24 as the jetting hose 30 penetrates the formation. This frictional drag can increase as the jetting hose 30 moves into the formation due to the increase in the length of the jetting hose within the lateral borehole 11. Although not shown on the drawings, the jetting hose 30 will typically lie along the bottom of the lateral borehole 11 as the borehole is created. The jetting nozzle 32 will continue to move forward, pulling the jetting hose 30 and/or the tubing string 20 along until the friction on the jetting head and tubing string exceeds this pulling force. The amount of force can be controlled and varied by controlling the amount of fluid J pumped through the jetting nozzle 32. By varying the number and diameter of these openings, the force at which the jetting nozzle 32 is propelled in the forward direction can be manipulated.

The high pressure fluid stream from the forward end of the jetting nozzle strikes the formation 14 as it moves forward, breaking down or disintegrating the formation and creating a borehole 11, estimated at ~1" inches in diameter in the illustrated example. If fluid pumping is continued as the jetting head 32 is withdrawn from the lateral borehole, a larger diameter borehole ~2" is created. The original hole created is approximately 1" going forward and enlarged to ~2" when pulling the hose out of the hole while still pumping fluid. This is mostly where the rearward jets contribute in enlarging the laterals.

The jetting head 32 may have a number of configurations in terms of the number of forward openings and rearward openings, and in its simplest form the jetting head 32 would generally be a solid cylinder with forward and rearward axial openings. The jetting head can be constructed from carbon steel, stainless steel, or other ferrous metal. Additionally other hard materials such as ceramic can be used.

The ideal condition is to have the jetting operation completely nozzle-driven, i.e. the penetration speed of the jetting head 32 in formation 14 is self-regulated (no pushing or restraining of the jetting hose 30 from the surface via the tubing string 20). For this self-regulation to happen, it is important that the feed-in rate of tubing 20 equals the jetting rate of hose 30 led by nozzle 32 through formation 14.

To solve this speed control problem with the use of standard coiled tubing 20 to convey hose 30, a speed control sub 100 according to the invention is operatively fixed to tubing 20 as shown in FIG. 2. Speed control sub 100 is configured to give the operator on the surface clear feedback signal on the relative speeds of coiled tubing 20 and nozzle head 32, and, in particular, whether the tubing 20 is being advanced faster than the nozzle 32 is able to extend into the lateral borehole by jetting. This signal is mainly a signal to the operator to slow down the feeding of the coiled tubing 20 into the borehole.

The speed control sub 100 can be constructed from carbon steel, stainless steel or other ferrous metal. Speed control sub 100 can be directly connected to the tubing 20 or to other devices on the end of the tubing. Alternatively, a collar or adapter such as that shown at 110 in the drawings can be used to attach the speed control sub 100 to the tubing 20.

As shown in FIG. 2, speed control sub 100 is connected at upper end cap 110 to the end of tubing 20. Jetting hose 30 is connected to the lower end of the speed control sub at a pressure-drop piston or sleeve 150 projecting from the bottom of the sub. The connections between tubing 20, cap 110, and sub 100 are preferably threaded connections as illustrated, but may take other forms. Likewise, the connection of hose 30 to the lower end of the sub is preferably a threaded connection such as threaded cap 160, but can take other forms.

Jetting fluid is pumped from the surface 12, by a pump of known type, through the coiled tubing 20 and the speed control sub 100 into jetting hose 30, and exits through nozzle 32 at the end of the hose. As nozzle 32 creates lateral borehole 11, hose 30 must remain in tension to form the lateral borehole in a relatively straight direction. The forward force generated by the jet nozzle, due to its configuration, actually "pulls" the jetting hose through the formation 14 as it moves forward. The tubing 20 must be fed into the wellbore 10 at the same speed at which the nozzle moves forward in the reservoir. If the speed at which the tubing 20 is lowered ever exceeds the nozzle speed, speed control sub 100 "shifts", that is, the sleeve 150 moves in relation to the sub's main housing 120, resulting in a noticeable pressure drop at the surface. The speed at which the coiled tubing is lowered can then be reduced to a speed at which no shifting of the speed control sub occurs.

Figure 4:
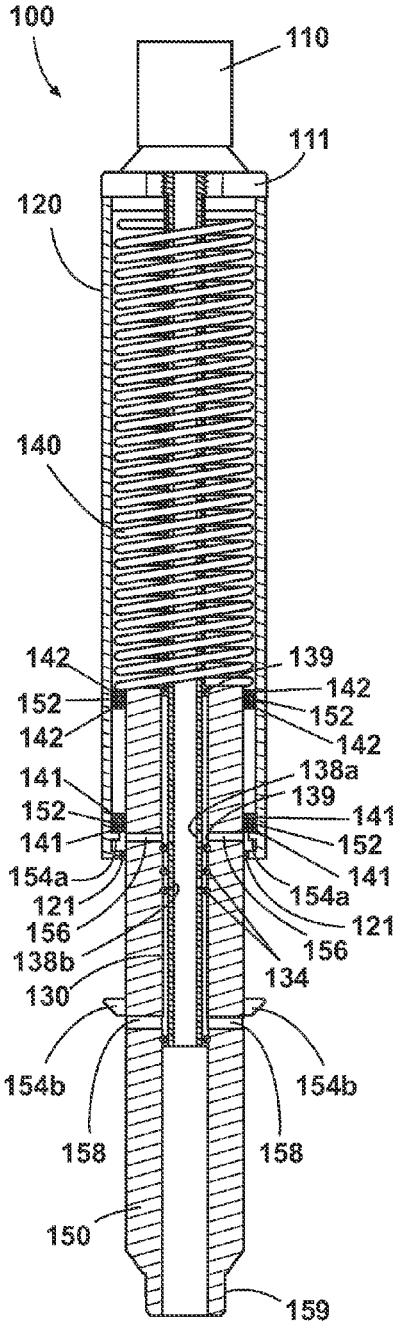
FIG. 4 is a side elevation view of the speed control sub of FIG. 2 in an un-shifted condition corresponding to a desirable tubing feed-in rate.
Figure 7:
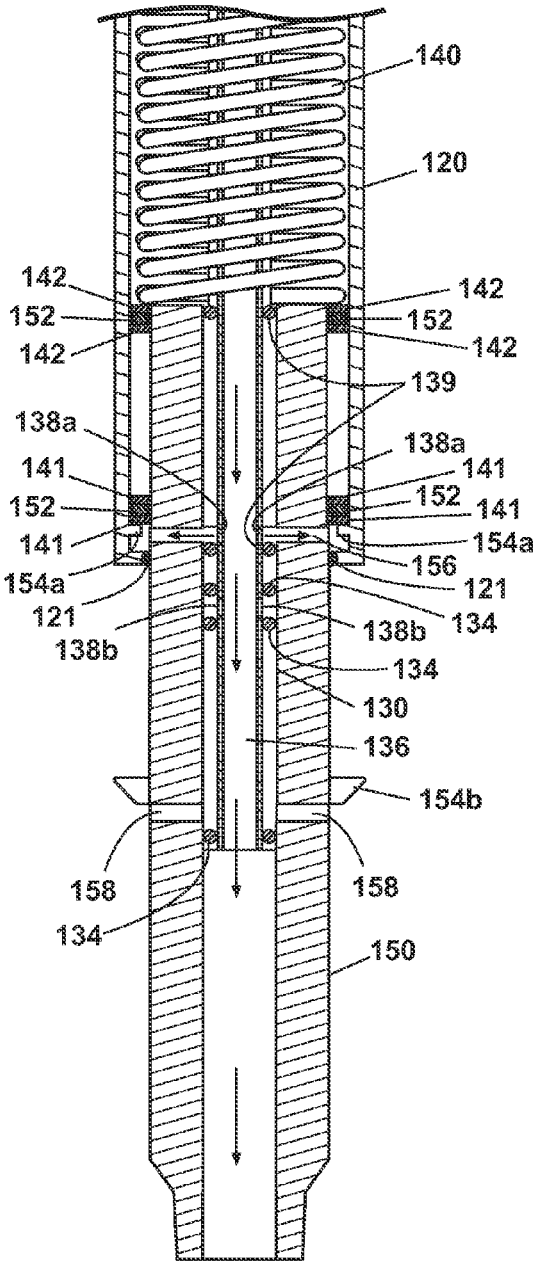
FIG. 7 is a detailed view of the un-shifted speed control sub of FIG. 4, illustrating the jetting fluid flow path through the sub.

Referring now to FIGS. 3 through 6, speed control sub 100 has the following main components: a tubular main housing 120, connected at its upper end to tubing 20 (via cap 110 or some other connector); a tubular inner fluid-conducting core 130 in fluid communication with tubing 20; a shift control compression spring 140 positioned in the upper part of the main housing 120 around core 130; and a tubular piston or sleeve 150 slidably mounted within housing 120 in operative contact with the lower end of spring 140. Sleeve 150 is further slidably mounted over core 130 in the lower part of housing 120, and is normally biased downwardly by spring 140 so that it is projected out of the bottom of housing 120 as shown in FIGS. 3, 4, and 7. Jetting hose 130 is connected to the lower end of sleeve 150, for example, with cross over connector 160, and is in fluid communication with core 130 to receive jetting fluid from tubing 20 through the speed control sub 100.

In the illustrated embodiment, main housing 120 is a tubular section of pipe, generally less than 2½" in outside diameter and constructed from high quality steel or other high strength materials such as stainless steel, titanium, or other known materials suitable for downhole environments. Housing 120 will generally be from six to eighteen inches in length, and have an internal finish suitable for hydraulic sealing by one or more piston rings 141 and 142 located on sliding sleeve or piston 150 in sliding contact with the inner surface of housing 120. Piston rings 141 and 142 each comprise a pair of rings that are separated by an O-ring 152. Housing 120 can withstand fairly high hydraulic pressures of up to 10,000 psi, for example, and should be able to transmit tensile force as well. Main housing 120 can be made from one piece of material or from several pieces connected together by threaded connections or other means. In addition, housing 120 has at its lower end a bottom shoulder 121 that has an inner groove that mounts an O-ring that seals against the outer surface of the sliding sleeve or piston 150.

Inner core 130 is a tubular section with threads 132 on the upper end to connect to mating threads (not shown) in the interior of cap 111 on the upper end of main housing 120. Inner core 130 includes O-rings 134 and 139 along its length to create effective hydraulic seals between core 130 and sleeve 150. The length of inner core 130 is longer than that of housing 120, and thus the lower end of core 130 projects out from the bottom of the housing. Inner core 130 is preferably constructed of high quality steel, stainless steel, high-strength composite material, titanium, or other suitable materials. Inner core 130 can be constructed from a piece of small diameter pipe or tubing or can be machined from a piece of stock. Inner core 130 has an interior axial fluid-conducting passage 136 extending its full length and communicating with tubing 20 through cap 110 and with hose 130 through the lower end of sleeve 150. Inner core 130 also includes upper and lower radial fluid bypass ports or orifices **138*a* and 138*b*, respectively, communicating with passage 136 and sized to release a known amount of the jetting fluid traveling through passage 136. Upper ports 138*a* selectively release fluid from passage 136 into and through pressure compensating ports 156 in sleeve 150 and into housing 120 illustrated in FIG. 4. The release of fluid through ports 156 is constant no matter which location the inner core 130 is in relation to the sleeve or piston 150. The purpose of this fluid is to compensate for the downward force generated on the piston 150 by the pumped fluid. The pumped fluid in the annulus between the housing 120 and piston 150 and between ring 141 and bottom shoulder 121 exerts an upward force on piston 150** that compensates the downward force from the pumped fluid.

Figure 5:
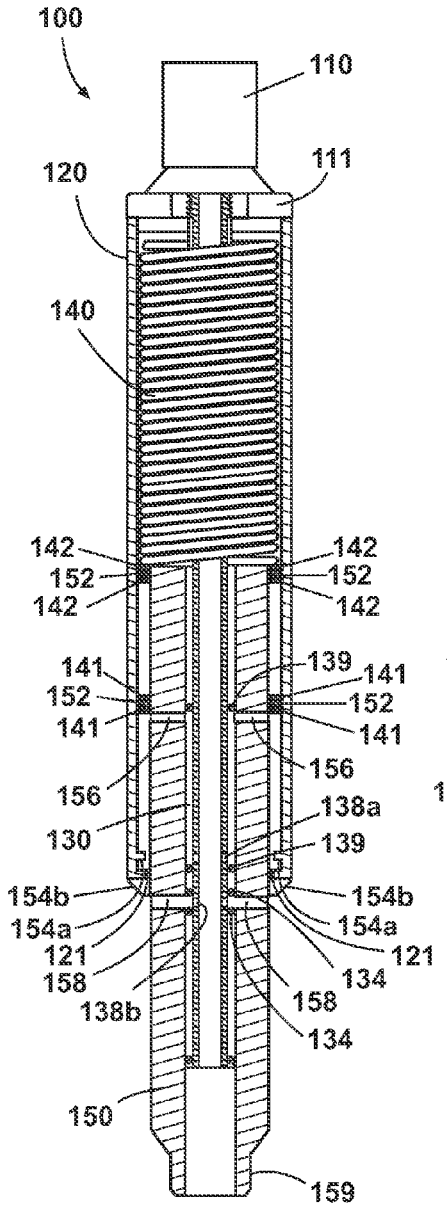
FIG. 5 is a side elevation view of the speed control sub of FIG. 2 in a shifted condition corresponding to an undesirable tubing feed-in rate, which generates a pressure drop indication to the operator.
Figure 6:
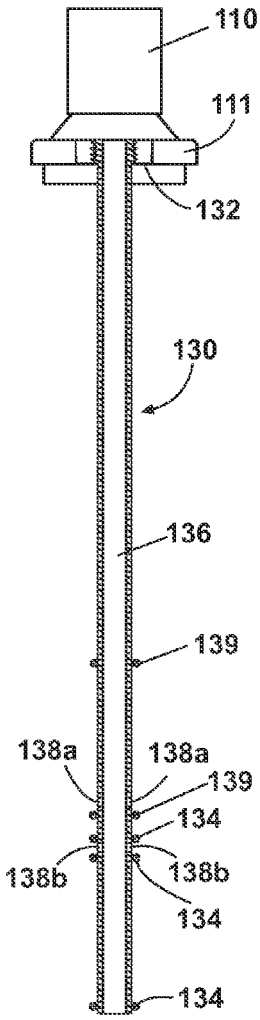
FIG. 6 is a side elevation view of an inner core portion of the speed control sub of FIG. 2.

In addition, lower ports 138*b* selectively release fluid into and through pressure relief ports 158 in sleeve 150 to the exterior of the sub 100, and into the production tubing 18 or main wellbore 16 when the sleeve 150 is in the retracted position as illustrated in FIG. 5. The threaded connection of the upper end of inner core 130 to the cap 111 of main housing 120 fixes core 130 to the housing 120, Sliding piston or sleeve 150 is a tubular section having one or more rings, 141, 142 and 154*b*, for example, which are mounted on its outer surface; rings 141 and 154*b* act as "no go" devices. Ring 141 and 142 have grooves on their outside to house O-rings 152. One or more bypass passages 156 pass internal fluid from the annulus between the piston 150 and inner core 130 to the annulus between the piston 150 and the main housing 120 to compensate for the downward pressure on piston 150 exerted by fluid J by exerting same pressure between piston 150 ring 141 and housing 120 bottom shoulder 121. Through proper sizing of the area of ring 141, the pressure pushing upward on ring 141 is same as pressure pushing down on piston 150. One or more exterior pressure-relief passages 158 communicate with the exterior environment around the sub 100. Sleeve 150 is threaded on its lower end at 159 for a connection with jetting hose 30, for example, through a cross over connection 160 as illustrated in FIG. 3. The outside diameter of sleeve 150 is less than the inside diameter of main housing 120 so that the sleeve 150 can axially slide within the main housing 120. Sleeve 150 outer Ring 141 abuts inner "no go" shoulder 154*a* at the lower end of main housing 120 to limit downward movement of the sleeve 150 relative to the housing 120. Outer over-gauge ring 154*b* abuts shoulder 121 from the outside of the lower end of main housing 120 to limit upward movement of the sleeve relative to the housing. O-rings 152 create a sliding seal between sleeve 150 and housing 120. Sleeve 150 will generally be between 1" and 2" in diameter, and generally between 4" and 12" in length, and is constructed from high quality steel, stainless steel, titanium, high strength composite materials or other suitable materials. Like the main housing 120, sleeve 150 is configured to withstand high hydraulic pressures of 10,000 psi or more and must also be able to transmit tensile forces.

The upper end of sleeve 150 engages spring 140, which could be fixed to either the housing 120 or to the upper end of sleeve 150. Illustrated spring 140 is a helical compression spring located between the main housing 120 and inner sleeve 150. Spring 140 is compressed between the upper end of the main housing and the upper end of sleeve 150. Spring 140 creates the bias force that must be overcome in order to "shift" the speed control sub 100 by moving the sleeve 150 upwardly from its normal fully extended position. Springs of different strengths can be used, depending on the desired force for shifting the speed control sub. Although a helical compression spring is shown, other types of springs can be used, such as bellows type springs. Spring 140 is preferably constructed of high strength "bow spring" steel.

It will be understood that a hydraulic system can be used in speed control sub 100 as an equivalent to spring 140. Fluid pressure can be used in lieu of a spring to control the force required to shift the sub. Using fluid pressure to control the operation of speed control sub 100, whether instead of or in addition to spring 140, incorporates a time delay feature into the sub, where a force greater than the force required to shift the speed control sub must be applied for a given time measure in seconds or minutes before the speed control sub shifts.

Now that the main structural components of speed control sub 100 have been described, their functional interaction to cause a pressure-drop inducing "shift" in response to tubing feed-in rate will now be explained.

FIG. 7 shows sub 100 in the un-shifted position, maintained while the feed-in rate of tubing 20 does not exceed the rate of advance of the jetting hose 30 while jetting a lateral borehole. In the un-shifted position, sleeve 150 is extended a first greater distance from housing 120. Upper ports 138*a* are aligned with passage 156, providing some jetting fluid from passage 136 in core 130 to enter the space between the sleeve 150 and housing 120. This fluid exerts pressure between ring 141 of sleeve 150 and bottom end 121 of housing 120 to compensate for downward pressure on sleeve 150, thereby neutralizing the effect of the pumped fluid on sleeve 150. Lower ports 138*b* are misaligned with lower passages 158 in sleeve 150, preventing fluid from leaving core 130 through lower passages 158. Seals 139 on core 130 above and below ports 138*a* contain the fluid released from ports 138*a* in the space between core 130 and sleeve 150, such that the only outlet for the released fluid is through upper passages 156 in the sleeve into the "compensating" volume between sleeve 150 and housing 120 below the lower seal 152. In the unshifted condition of FIG. 7, the compensating volume for this fluid is relatively small but the compensating pressure against bottom of ring 141 is always the fluid pumping pressure in any position which insure constant compensation for sleeve 150.

Figure 8:
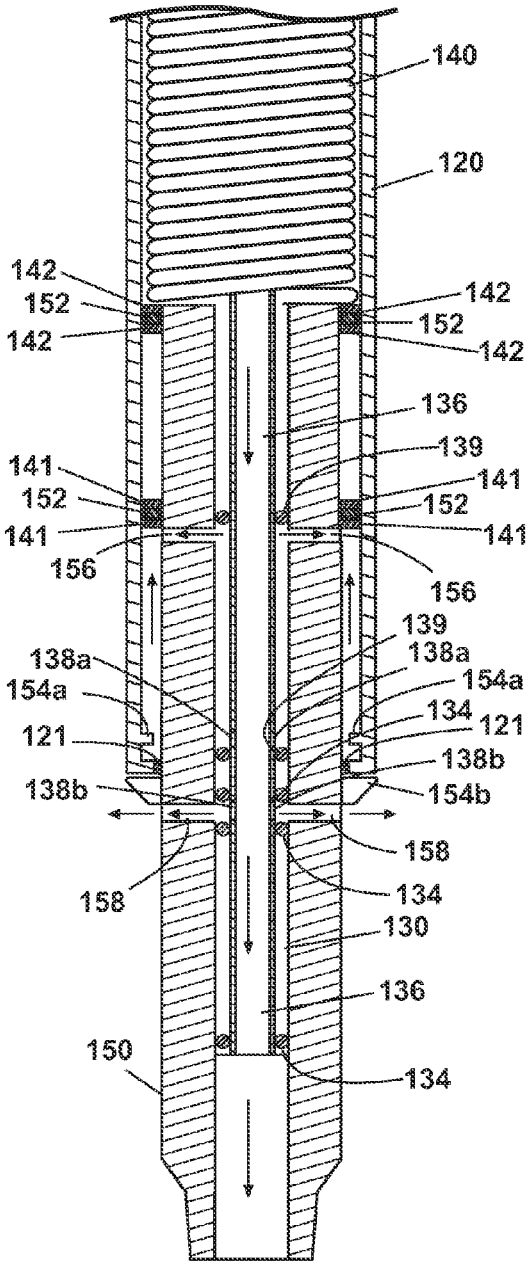
FIG. 8 is a detailed view of the shifted speed control sub of FIG. 5, illustrating an altered jetting fluid flow path that induces a pressure drop indication to the operator.

FIG. 8 shows sub 100 in the shifted position, which occurs when the feed-in rate of tubing 20 exceeds the rate of advance of the jetting hose 30 while jetting a lateral borehole. Since sleeve 150 is operatively fixed to the jetting hose 30, and operatively spaced relative to housing 120 by the spring 140, advancing tubing 20 too quickly forces the housing 120 down relative to the slower moving sleeve 150, compressing spring 140 until the lower end 121 of the housing engages no-go ring 154*b* on the sleeve. This shift brings lower ports 138*b* into alignment with passages 158, thereby venting a known quantity of the jetting fluid J in core 130 into the essentially unlimited volume of the production tubing and/or wellbore around the sub 100. This venting produces a pressure drop noticeable to the operator of the tubing at surface, for example, via pressure gauges measuring the pressure of the jetting fluid, indicating that the operator should slow the feed-in rate of the tubing. The magnitude of the pressure drop, and the speed at which the pressure drop occurs as observed by the operator, will depend on several factors that will be recognized by those skilled in the art, including the pressure of the jetting fluid, the size of the ports 138*b*, the skill of the operator, and the downhole pressure in the wellbore or production tubing around sub 100.

Passages 156 continue to release compensating fluid pressure from ports 138*a* in the shifted condition, as the volume between the housing 120 and sleeve 150 below lower seal 152 expands to that shown in the fully shifted condition of FIG. 8. The amount of pressure between ring 141 and shoulder 121 is constant regardless of the position of the piston 50 with respect to housing 120 so that the pressure differential of the pumped fluid on the piston 50 is constant at all time. The result of this configuration is to make the downward force on the piston from the pumped fluid always balanced by an equal force pushing up on same piston 50, thereby leaving the tension in the spring 140, the feeding of the tubing and the resistance from the hose 30 against the formation 14 as the only forces affecting the movement of the piston 50 with respect to the housing 120.

Figure 11:
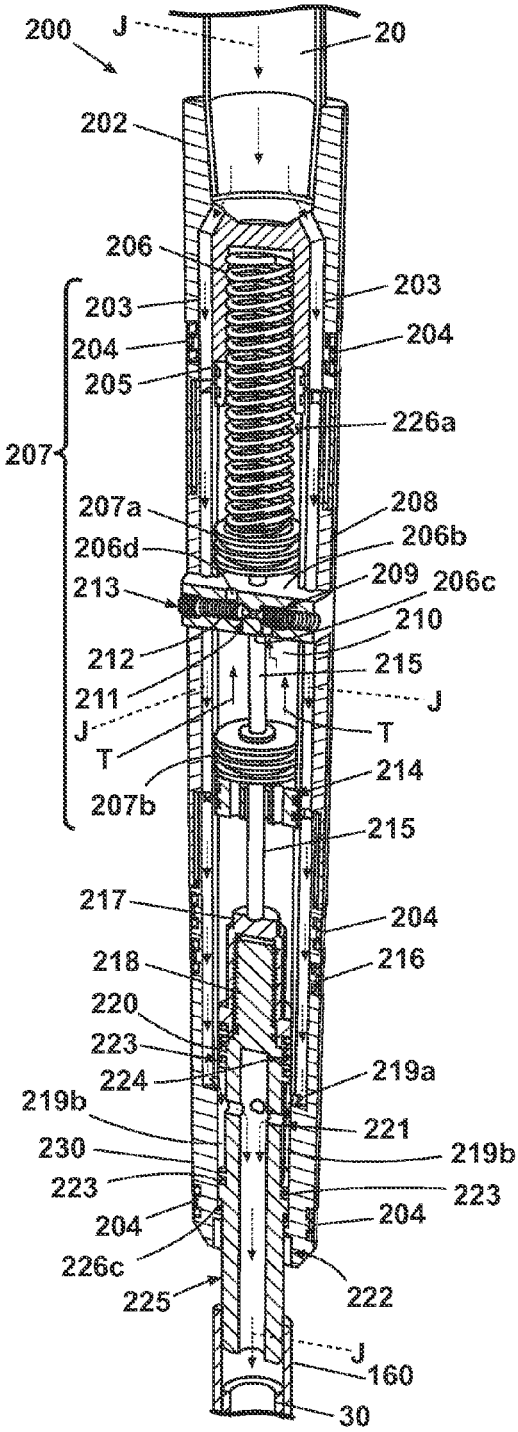
FIGS. 11 and 12 show an alternate embodiment of a speed control sub according to the invention, in cutaway perspective view, in the un-shifted and shifted positions, respectively.
Figure 12:
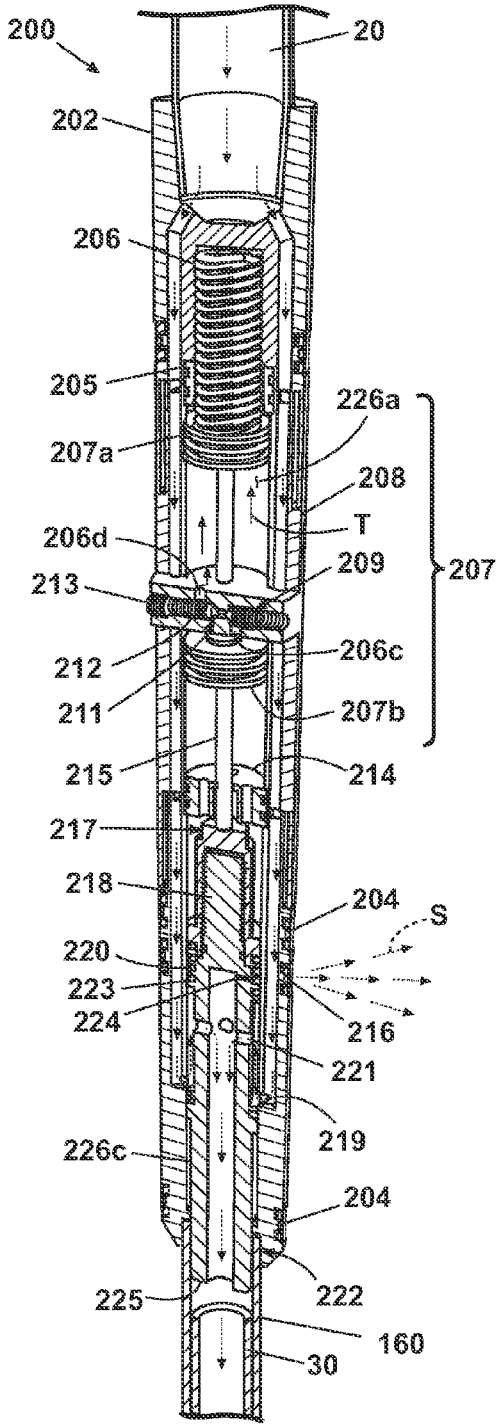

Referring next to FIGS. 11 and 12, an alternate embodiment of a speed control sub is shown at 200. The connections of sub 200 to tubing 20 and to jetting hose 30 can be the same as, or similar to, those shown for sub 100 in FIGS. 2 through 8.

Sub 200 is shown in the illustrated example as comprising an upper housing 202, a middle housing 208, and a lower housing section 230, all or which are tubular components made, for example, from steel or stainless steel, but not limited to those materials. Sections 202, 208, and 230 are assembled using known methods, for example, with threaded sealed connections or by welding, and some or all of their junctions may be further sealed with additional internal seals such as the O-ring seal structure 205 where the upper and middle housing sections 202 and 208 are joined. The result is a substantially tubular sub housing, but the sub 200 is not limited to using such a multi-part main housing structure as illustrated in FIGS. 11 and 12.

Jetting fluid J enters the upper end of sub 200 from tubing 20 and flows through one or more conduits 203 formed in the walls of the sub housing(s), until the jetting fluid enters bore 225*a* in the "sleeve" of spool valve shaft 225 in the lower end of sub 200. The jetting fluid then exits the lower end of the sleeve 225 into jetting hose 30, which is connected to the lower end of the sleeve. Conduits(s) 203 may be referred to as an "outer bore" of the sub 200.

The middle housing 208 houses a damping or timing assembly 207. A first chamber 226*a* is formed in a cavity between the upper housing 202 and the middle housing 208. A compression spring 206 is mounted in the first chamber 226*a* between the upper end of the chamber 226*a* and an axially slidable piston or ram 207*a*. A rod 215 is mounted for reciprocation in substantially sealed fashion through a partition 206*b* and is connected at an upper end to the piston or ram 207*a* and a mid portion to a piston or ram 207*b* that is axially slidable in a second or "timing" chamber 226*b*. The partition 206*b* separates the first and second chambers 226*a* and 226*b*. The lower end of rod 215 is connected to sleeve 225 through a sealed rod guide 214 that defines the lower end of the second or timing chamber 226*b*.

The volume between the sealed, sliding piston rams 207*a* and 207*b* is filled with hydraulic damping fluid T, for example Glycol. The hydraulic fluid is driven into and out of timing chamber 226*b*, through metered opening 206*c* and pressure control opening 206*d* in partition 206*b*, by reciprocating movement of rams 207*a* and 207*b* relative to the partition. The rate at which the fluid T can be driven through opening 206*c* in the partition 206*b* is adjustably controlled, for example, by a metering valve that is adjustable by set screw 209*a*. The metering valve thus controls the rate of flow through the metered opening 206*c* and thus the speed at which the sleeve 225 travels in either direction. A ball check valve and spring structure 211, 212, adjustable with an adjustment spring plug 213, controls the pressure in chamber 226*b* at which fluid is allowed to pass through the pressure control opening 206*c* and thus prevents premature shifting of the sleeve 225 under relatively low forces on the sleeve 225 by the jetting hose. In a preferred embodiment of the invention, there are two metered openings 206*c*, each with a metering valve, spaced opposite each other and two pressure control openings opposite each other but spaced 90 degrees from the metered openings 206*c* about the axis of the speed control sub 200. Other metering structures and devices can be used, or the metering structure may be omitted in favor of non-adjustable metered openings. The first and second chambers 226*a*, 226*b*, the pistons 207*a* and 207*b*, the connecting rod 215 and the metered opening 206*c* and pressure control opening 206*c* form the timing or damping assembly 207.

Sleeve 225 reciprocates in the lower end of the sub housing, in a hydrostatic pressure chamber 226*c* divided by sliding seals 223 on the exterior of sleeve 225 into upper and lower hydrostatic pressure chambers that, along with upper chamber 226*a*, freely admit fluid from the exterior of sub 200 through screened ports 204. These chambers, in constant fluid communication with the surrounding fluid pressure in the well, equalize the internal sub pressure with the outside hydrostatic pressure to balance the piston rams 207*a* and 207*b*, preventing the sub from shifting prematurely. These hydrostatic chambers are important to the tool functions. Without these hydrostatic chambers 226*c*, the sleeve 230 may prematurely shift at well bore depth hydrostatic pressures that exceed the spring 206 force or at surface high well bore pressures.

Timer guide 214 is provided with holes for this equalizing fluid pressure to communicate with the bottom of lower piston ram 207*b*. Timer guide 214 can also include exterior seals, for example, o-rings, to help seal the junction of the middle and lower sub housings.

Sleeve 225 is sealed relative to the lower housing at spaced locations with sliding seals 223. Seals 223 define an elongated jetting fluid path 219*b* that remains in fluid communication with ports 219*a* throughout the range of travel of sleeve 225 in the sub. Ports 221 in sleeve 225 admit the jetting fluid from 219*b* so that it can flow to jetting hose 30.

The lower section of the sub housing, adjacent sleeve 225, is provided with a bypass port 224 that is in fluid communication with an open groove 220 around the exterior of the sleeve 225. Open groove 220 is in selective fluid communication with a bypass port 216 in the sub housing when the sub "shifts", i.e. when sleeve 225 is forced upwardly from its extended position (the un-shifted or "running" mode of FIG. 11) to the shifted or "bypass" pressure relief mode of FIG. 12. When this shift occurs, a portion of pressurized jetting fluid in sleeve 225 is vented to the exterior of the sub, causing a pressure drop in the jetting fluid being pumped down the well. This pressure drop will be easily detected by an operator controlling the feed-in rate of tubing 20 from the surface, for example, as a drop in surface pump pressure read via a gauge. Sleeve 225 provides sliding seals above and below open groove 220 relative to the sub housing, to prevent any jetting fluid leakage before the bypass ports on the sleeve and sub housing can line up.

In the running or un-shifted mode of FIG. 11, spring 206, piston 207, and sleeve 225 are all extended. Timing fluid T is located in timing chamber 210 below partition 206*b*, and jetting fluid J flows at its expected pressure through the outer bore of sub 200 in conduits 203, exiting the sleeve 225 into jetting hose 30. If the nozzle 32 on the end of jetting hose 30 hits a rock or hard formation, or for some other reason the feed-in rate of tubing 20 exceeds the rate of advance of the jetting hose, the jetting hose 30 starts pushing sleeve 225 back up into sub 200. Timing piston 207*a* is thus forced upwardly against spring 206, but must force timing fluid T through the metering valves in partition 206*b*, which (if such metering valves are provided) provides a time delay for the shift of sleeve 225. The length of the delay is adjusted by adjusting the rate at which timing fluid T is able to be forced out of timing chamber 210 through the metering structure at 206*b* by lower piston ram 207*b*, primarily by adjusting the size of the orifice 206*c* with the metering valve set screw 209. The force or pressure beyond the spring force of spring 206 at which the sleeve 225 can begin to shift is adjusted with the spring check valve 211, which functions as an adjustable pressure regulator.

When sleeve 225 shifts upwardly against spring 206 enough to align open groove 220 and bypass orifice 224 on the sleeve with bypass port 216 on the sub housing, enough pressurized jetting fluid J is released in a radial spray S to provide the noticeable pressure drop to the operator.

When the rate of advance of jetting hose 30 speeds up to equal or exceed the tubing feed-in rate, spring 206 will return the sleeve to the running mode of FIG. 11. This return to the unshifted condition also requires a metered return of the timing fluid T to timing chamber 210, forced by the upper piston ram 207*a* through the metering orifice 206*c* in partition 206*b*. This delay in the sleeve return gives the timing structure time to reset slowly in case the jetting hose nozzle stops again.

If more than one lateral borehole is being jetted at a given depth, it may be desirable to operate an indexer or other deflector-reorienting device such as 26, for example, by limited reciprocation of the tubing string 20, and then to repeat the jetting process described above until the desired number of lateral boreholes is jetted. When the last lateral borehole is done at this depth, the tubing string 20 with the hose 30 can be pulled back up to the surface.

Whereas the invention has been described with respect to a pressure signal to an operator by way of a significant drop in pressure of the jetting fluid, it is within the scope of the invention to modify the speed control sub to generate a noticeable pressure increase to the operator instead of a pressure drop when a force between the speed control sub and the jetting hose increases from a first predetermined level to a second predetermined level. For example, a valve can be provided within the speed control sub to at least partially close passage to the jetting hose when a sleeve attached to the jetting hose is forced upwardly with a housing in the speed sub to restrict flow through the speed control sub, thereby dramatically increasing the pressure of the jetting fluid that is detected at surface by the operator. When the jetting hose pressure on the sleeve decreases, the valve can be opened by the movement of the sleeve with respect to the housing to resume normal operation of the jetting operation.

It will be understood that the disclosed embodiments are representative of presently preferred forms of the invention, but are intended to be explanatory rather than limiting of the scope of the invention as defined by the claims below. Reasonable variations and modifications of the invention as disclosed in the foregoing written specification and drawings are possible without departing from the scope of the invention as defined in the claims below. It should further be understood that the use of the term "invention" in this written specification is not to be construed as a limiting term as to number of inventions or the scope of any invention, but as a descriptive term which has been used to describe advances in technology The scope of the invention is accordingly defined by the following claims.

What is claimed:

1. An apparatus for jetting lateral boreholes in a formation from a main wellbore using a high pressure jetting hose conveyed down the wellbore by tubing, the jetting hose supplied with pressurized jetting fluid through the tubing;

a speed control sub connected between at least a portion of the tubing and the jetting hose, the speed control sub comprising a jetting fluid path for passing the pressurized jetting fluid from the tubing portion to the jetting hose; wherein the speed control sub is configured to maintain the pressure of the jetting fluid flowing to the speed control sub at a predetermined level when a force between the speed control sub and the jetting hose is at a first predetermined level and to change the pressure of the jetting fluid flowing to the speed control sub from the predetermined level when the force between the speed control sub and the jetting hose increases from the first predetermined level;

whereby the speed control sub is responsive to a higher feed-in rate of the tubing down the wellbore relative to a thrust-determined jetting rate of the hose through the formation to cause a noticeable pressure change in the pressurized jetting fluid to an operator.

2. The apparatus of claim 1, wherein the speed control sub has a first part that is connected to the jetting hose and a second part that is connected to the portion of the tubing, and wherein the first and second parts are axially movable with respect to each other.

3. The apparatus of claim 2 wherein the first and second portions are biased with respect to each other toward a first relative position.

4. The apparatus of claim 3 wherein the first and second parts of the speed control sub are in the first relative position when the force between the speed control sub and the jetting hose is at the first predetermined level.

5. The apparatus of claim 4 wherein the first and second parts of the speed control sub are in a second relative position when the force between the speed control sub and the jetting hose increases to a second predetermined level.

6. The apparatus of claim 4 and further comprising a damper to dampen the movement of the first and second parts of the speed control sub between the first and second positions.

7. The apparatus of claim 6 wherein the damper comprises first and second chambers connected by a restricted passageway.

8. The apparatus of claim 7 wherein the restricted passageway includes a metering valve.

9. The apparatus of claim 8 wherein the speed control sub is configured to change the pressure of the jetting fluid flowing to the speed control sub from the predetermined level only when the force between the speed control sub and the jetting hose increases to a second predetermined level.

10. The apparatus of claim 8 wherein the speed control sub is configured to decrease the pressure of the jetting fluid flowing to the speed control sub from the predetermined level when the force between the speed control sub and the jetting hose increases.

11. The apparatus of claim 10 wherein the speed control sub is configured to decrease the pressure of the jetting fluid flowing to the speed control sub from the predetermined level only when the force between the speed control sub and the jetting hose increases to a second predetermined level.

12. The apparatus of claim 1 wherein the speed control sub further comprises a vent in the jetting fluid path to vent pressurized jetting fluid from the jetting fluid path when the force between the speed control sub and the jetting hose is increased from the first predetermined level.

13. The apparatus of claim 12 wherein the vent is adapted to vent the jetting fluid only when the force between the speed control sub and the jetting hose increases to a second predetermined level.

14. The apparatus of claim 1 wherein the speed control sub further comprises a vent in the jetting fluid path to vent pressurized jetting fluid from the jetting fluid path when the force between the speed control sub and the jetting hose is increased from the first predetermined level.

15. The apparatus of claim 14 wherein the vent is adapted to vent the jetting fluid only when the force between the speed control sub and the jetting hose increases to a second predetermined level.

16. The apparatus of claim 1 wherein the speed control sub is configured to change the pressure of the jetting fluid flowing to the speed control sub from the predetermined level only when the force between the speed control sub and the jetting hose increases to a second predetermined level.

17. The apparatus of claim 1 wherein the speed control sub is configured to decrease the pressure of the jetting fluid flowing to the speed control sub from the predetermined level when the force between the speed control sub and the jetting hose increases.

18. The apparatus of claim 17 wherein the speed control sub is configured to decrease the pressure of the jetting fluid flowing to the speed control sub from the predetermined level only when the force between the speed control sub and the jetting hose increases to a second predetermined level.

19. A method for jetting lateral boreholes from a main wellbore using a high pressure flexible jetting hose comprising:

lowering the high pressure flexible jetting hose down a wellbore with a tubing string while supplying the jetting hose with pressurized jetting fluid through the tubing string from the surface; and, providing a noticeable pressure signal to an operator on the surface if a feed-in rate of the tubing string down the wellbore exceeds a predetermined rate of advance of the jetting hose through a formation adjacent the wellbore.

20. The method of claim 19 wherein the noticeable pressure signal is a drop in the pressurized jetting fluid.

* * * * *